United States Patent [19]

Aarons

[11] 4,182,090

[45] Jan. 8, 1980

[54] ROOF TILE FASTENING CLIP

[75] Inventor: Raymond J. Aarons, Jindalee, Australia

[73] Assignee: Monier Colourtile Pty. Ltd., Darra, Australia

[21] Appl. No.: 918,821

[22] Filed: Jun. 22, 1978

Related U.S. Application Data

[63] Continuation-in-part of Ser. No. 881,019, Feb. 24, 1978, abandoned, which is a continuation of Ser. No. 685,046, May 10, 1976, abandoned.

[51] Int. Cl.[2] ..... E04B 7/00

[52] U.S. Cl. ..... 52/489; 52/520; 52/547; 52/550

[58] Field of Search ..... 52/489, 520, 547, 548, 52/550, 483

[56] References Cited

U.S. PATENT DOCUMENTS 2,474,587 6/1949 Moore ..... 52/489

FOREIGN PATENT DOCUMENTS 91116 2/1923 Austria ..... 52/489

707473 4/1965 Canada ..... 52/483

*Primary Examiner*—James L. Ridgill, Jr.

*Attorney, Agent, or Firm*—Haseltine, Lake & Waters

[57] ABSTRACT

A roof tile fastening clip for securing a tile to a batten. The clip structure is formed of a body portion with a hook shaped configuration at one end and a nail or similar fastener incorporated at the opposite foot end.

4 Claims, 4 Drawing Figures

ROOF TILE FASTENING CLIP

BACKGROUND OF THE INVENTION

The present invention is a continuation-in-part of my pending continuation application, Ser. No. 881,019 filed Feb. 24, 1978, now abandoned which in turn is a continuation application of my previously filed, now abandoned application U.S. Ser. No. 685,046 filed May 10, 1976 entitled Roof Tiling Fastening.

More particularly, the present invention relates to a new and improved roofing tile fastening means such as a clip structure.

In normal practice, roofing tiles are supported by tiling battens which form part of the roof structure, and the tiles are secured to the battens either by wiring or by nailing. A tile which is to be wired in position is made with a lug projecting from its underside and in which there is formed a small hole through which the wire can be passed. A tile which is to be nailed in place is formed with a nail hole through which a nail may be driven into the batten below.

The formation, under a tile, of an apertured lug for wiring is not suited to modern methods of tile production, and the manufacture of tiles with this provision is relatively slow and expensive. The provison of nail holes is also troublesome, as the formed holes often tend to become blocked during subsequent stages of production of the tiles.

A considerable amount of time and trouble is required also in wiring tiles to battens, and this is done after actual laying of the roof tiles has been completed, and so is an additional function. Nailing of tiles is done as the laying proceeds, but it is likely to result in difficulties experienced in nailing fairly brittle tiles to battens which may be unsupported and somewhat springy beneath the nail, and consequent breakage of tiles. In neither case are the tiles held with satisfactory firmness to the roof structure, and high winds are liable to cause sufficient reduction in pressure over areas of a roof to cause tiles to be lifted by suction, resulting in some disintegration of the tiles.

In the past the usual approach to securing roofing tiles has involved wiring the tiles from underneath to the battens or by nailing through prepunched holes near the top of the titles into the batten below. However, the prior art as is typified by such approaches is quite expensive and inefficient especially with respect to situations in which the roofs are subjected to abnormal wind conditions.

SUMMARY OF THE INVENTION

It is the main object of the present invention to overcome the objects of the prior art.

It is another object of the present invention to provide a simple and economic means for constructing roofs of a tile structure where such tiles are affixed to battens.

It is still another object of the present invention to have the nail enter the tiling batten at a predefined plane of penetration.

By means of the present invention, there is provided a simple and highly economical basis by which roofs can be constructed through the employment of the inventive article for affixing the tiles to the battens. It is furthermore submitted that the uniqueness and the novelty of the present design is such that the nail which is hammered into the tiling batten is always in positive contact and in the correct plane of penetration into the tiling batten by virtue of the unique configuration of the combined elements comprising the clip.

Other objects and advantages of the present invention will be more clearly understood with respect to the accompanying specification claims and drawings.

In accordance with the present invention, the clip is intended to cooperate with roofing tiles manufactured to interlock at the edges. The clip of the invention has a hook portion formed to fit bead on the underlap of the roofing tile but dimensioned so as not to touch inside water channel of the tile (if so during heavy rain, the water catches on the hook and is diverted into the roof area).

Design criteria in the clip is such that it is held from the top over the bead of the water course—this ensures a firm fit and also eliminates the possibility of fingers being hit by the hammer (as with nailing tiles). By experimental means it was found that the clip had to be fixed perpendicular to tiling batten. However, this caused an installation problem—nail was parallel to and slightly under tile, which is difficult to hammer. Hence, to overcome this problem a twist was formed in the body of the clip to bring the bead of the nail out from under the tile—hence easier installation.

In considering this point, the hook is formed so that the nail penetrates the batten in a downward direction. Owing to the confined area between the battens (2"×1" battens—maximum of 11½" space) the nail is easily driven into the batten. The angle of the nail orientation is intended to be approximately of the natural swing of the hammer. Also, the distance between the inside of the hook and the nail has been calculated to compensate for various thicknesses of tiling battens and the heights of water course beads on the various profiles of tiles. Lastly, the foot of the clip is formed to hold the nail in a captive situation. (Threading a nail into clip on site is time consuming—hence costly). In this regard, during manufacture of the tile clip, the nail has been forced into the foot so that the distance from the point of the nail to the inside edge of the body of the tile clip is the same as the thickness of the batten lugs of the tiles. This is to prevent the tile clip from twisting during the installation of the tile clip.

In most instances, the nail has to be driven a minimum of ⅜" into the tiling batten. Hence, the nail length is such to provide the ⅜" penetration, but also to eliminate the need for the nail to be driven completely home. It has been found that if the nail is driven home, the clip will twist and tend to lose its effectiveness and because of the minimal distance between the lap of the tiles, if any pressure is put onto the upper tile, (e.g. tiler or tradesman walking on roof) the edge of the upper tile will snap off. This tile then has to be replaced—hence time consuming and costly.

SHORT DESCRIPTION OF THE DRAWINGS

In order that a preferred embodiment of the invention may be readily understood and carried into practical effect, reference is now made to the accompanying drawings, wherein.

DETAILED DESCRIPTION OF THE PREFERRED EMBODIMENT OF INVENTION

Figure 1:
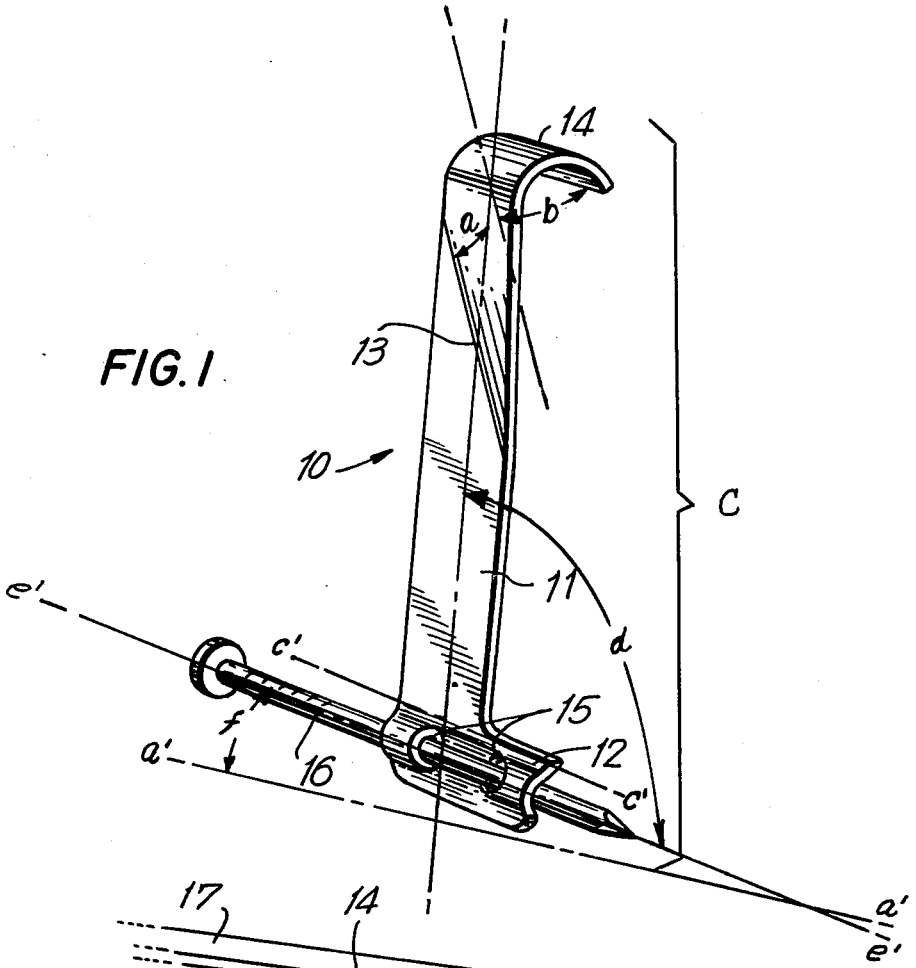
FIG. 1 is a perspective view of a roofing tile clip according to the invention.

A roofing tile clip C illustrated includes a body 10 stamped from sheet metal, preferably galvanized sheet steel, and of substantially L-shape, comprising a main strip 11, and an integral fairly short foot 12 extending perpendicularly from the normally lower end of the strip 11. The strip is formed with a bend through a small angle a at 13, at an intermediate position, and the normally upper end of the strip is curved arcuately to form a hook 14. The angulation of the hook 14 in respect to the body 10 is such that the axes of the radius of the hook is not coaxial with the axes of the body 10, but offset at an angle b to suit the natural angle of laying of the tile 17 in respect to the tile batten 20.

In actual fact the relationship of the hook 14 to the captive nail (as explained below) is, for example, a variation of $7\frac{1}{2}°$ off parallel to each other. Furthermore, since in most instances the roofing tile 17 is at about a 5° variance angle to the batten 20, it then follows that a $2\frac{1}{2}°$ downward slope of the nail 16 into the batten 20 below the end section horizontal axes of the batten is present.

Two apertures 15 are formed through the foot 12, and the metal of the foot is deformed, the sheet metal, between the two holes 15, being bent in one direction, to arcuate or semi-circular shape in cross-section, and the sheet metal of the two apertures 15 is bent in opposite direction, again to arcuate or semi-circular cross-section.

A fixing nail 16 is forced, from one side of the foot, through the two apertures 15, so that its point extends beyond the extended side of the foot. The nail 16 is a captive nail, its middle part being held frictionally in the foot of the device, the point of the nail being spaced from the extended side of the foot, and the nail head being spaced from the other side of the foot.

The axes of the apertures 15 (e'—e') and foot 12 (c'—c') are at a slight angle (off the perpendicular) to the axes of the batten 20 (a'—a') and furthermore are positioned at a slight downward angle t to the plane of the surface plane of the batten 20.

To elaborate further, firstly the twist in the vertical leg of the clip C is provided to point the nail 16 (located in the apertures 15 of the foot 12) at an angle to the edge of the batten 20 so as to clear the edge of the roofing tile 17 which is being clipped. This gives the installer an opportunity to strike the nail 16 with the hammer without hitting the roof tile 17. Further the slight downward angle of the nail 16 to the batten 20 is to provide the correct angle to drive and to suit the natural plane of the hammer head as it strikes the nail head when installation takes place.

Figure 2:
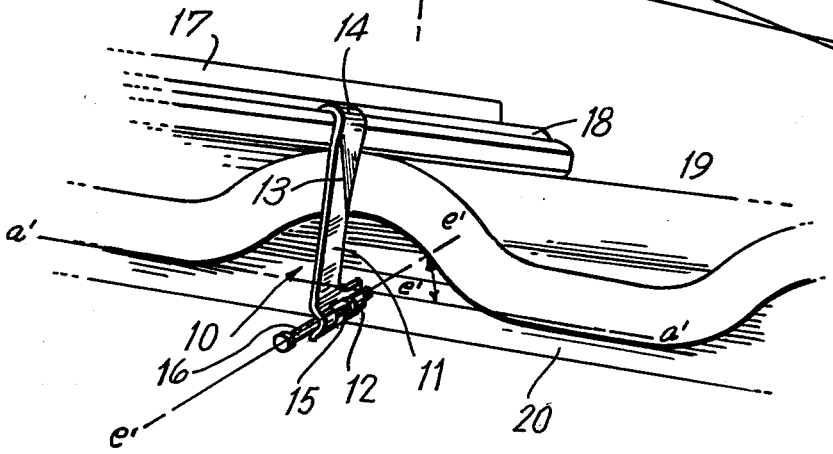
FIG. 2 is a perspective view showing the manner of attachment of roofing tiles by means of the clip.

FIG. 2 shows the way in which the roofing tile clip C is used to secure a tile 17. This tile is laid in usual way with its lower end 18 overlapping upper parts of two acjacent lower tiles already laid, part of one of these lower tiles being indicated at 19. The clip C is placed with its hook 14 engaged over a side edge portion of the upper tile 17, the main strip 11 of the clip C extending down close to the upper end of the lower tile 19, the foot 12 of the clip C extending under the upper end of the lower tile 19 towards the tiling batten 20 engaging under and supporting the upper ends of the lower run of tiles 17. The captive fixing nail 16, then, is correctly located to be driven into the batten 20 by a stroke or two of a hammer, and when the clip C is fixed, it serves to hold the upper tile 17 firmly down on the lower tile 19, and the lower tiles 19 onto the tiling batten 20. The next tile of the upper run is then laid, overlapping at one side, the opposite side of the tile 17, and the hook 14, its lower part overlapping upper parts of the lower tile 19 and of the next succeeding lower tile, and this next upper tile to be laid is fixed, with a clip as before described; and so on.

Figure 3:
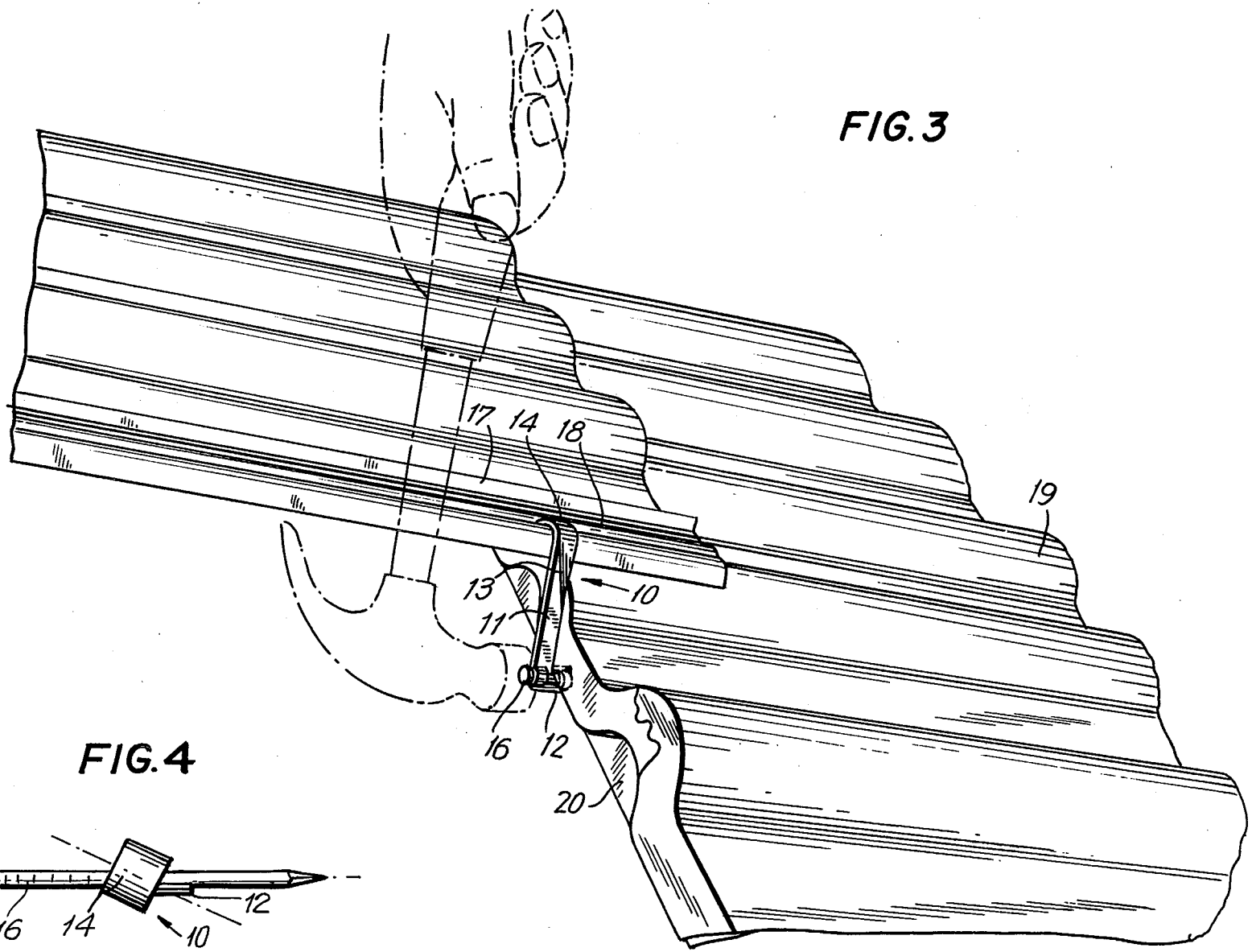
FIG. 3 is a perspective view of the invention illustrating the joining of two adjacent tiles.
Figure 4:
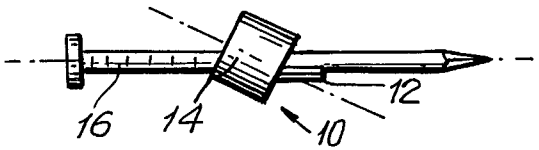
FIG. 4 is a top plan view of clip assembly.

As shown in FIG. 3, by offseting the hook section 14 of the clip C from the main portion or elongated extending portion the nail 16 retained by the apertures 15 in an extending surface of foot 12 is always at a drive angle into the timber to assure positive penetration to such batten 20. The result is a degree of firmness of attachment of the tile 17 to the batten 20. By virtue of the present invention, it is possible to have the nail 16 as driven by the installer penetrate the timber of the batten 20 at an angle such that the head of the nail is approximately parallel to the hammer head during the advance of the nail 16. This is quite important since the installer is usually situated on a sloping roof structure and to have achieved this by way of the arrangements shown in the prior art is highly questionable. By virtue of the present invention the nail 16 is automatically at each drive of the hammer oriented slightly downward at an angle with respect to the batten 20 to accordingly cause the hook section 14 of the clip C to pull the edge of the tile 17 surface to which it is engaged further down to the batten 20.

Load tests applied to simulate wind uplift forces have proven the ability of the clip C assembly to withstand hurricane force winds without any adverse effects. Such tests have clearly indicated that the favorable results are in no small measure due to the relationship of the angulation or offset of the hook section 14 and the position of the nail 16.

In this way, each tile, as it is laid, is secured in place by a clip, the fixing operation being carried out quickly and easily. When the tiling operation has been completed, each tile is firmly fixed to the roof structure without any likelihood of the tiles being damaged by the fixing operation, and in such a way that there is no likelihood of the tiles being so lifted suctionally in a high wind as to cause roof disintegration.

What is claimed is:

1. A roofing tile clip for use in affixing roofing tiles to a roofing structure; said roofing structure having a tiling batten disposed to support said tiles thereon, said batten having a first longitudinal axis a'—a'; a lower tile supportable by said batten having an upper part; an upper tile having a lower side portion, said upper part being overlappable by said lower side portion of said upper tile; said roofing tile clip for securing said upper tile to a planar surface of said batten, having first and second ends being normally upper and lower ends respectively; said first and second ends being of unitary construction and forming opposite ends of a central body portion of said clip; holding means at said normally upper end of said clip disposed for engaging said lower side portion of said upper tile; fixing means for securing said normally lower end of said clip to said batten, and wherein: said clip includes an integral foot having a second longitudinal axis c'—c' and extending laterally towards said batten, first and second apertures coaxial with and spaced from one another along a third axis e'—e' and being formed in said foot, said fixing means including a captive nail engaged in, and frictionally constrained against movement through said apertures in said foot, the axis of the apertures and of the foot being formed at an angle e with respect to the first longitudinal axis a'—a' and at an incline f with respect to a plane formed by said batten surface.

2. A roofing tile clip as claimed in claim 1, wherein; said central body portion being defined by an elongated member having a permanently formed offset whereby said respective first and second ends are oriented in corresponding offset relationship.

3. A roofing tile clip as claimed in claim 1, wherein: said holding means being formed as a hook integrally formed at said upper end of said clip.

4. A roofing tile clip as claimed in claim 3, wherein said hook being formed with a central axis forming an angle with respect to the vertical axis of said central body.

* * * * *